US012318649B2

(12) United States Patent
Brown

(10) Patent No.: US 12,318,649 B2
(45) Date of Patent: Jun. 3, 2025

(54) WEIGHTED CLOTHING

(71) Applicant: Megan Elizabeth Brown, Rancho Palos Verdes, CA (US)

(72) Inventor: Megan Elizabeth Brown, Rancho Palos Verdes, CA (US)

( * ) Notice: Subject to any disclaimer, the term of this patent is extended or adjusted under 35 U.S.C. 154(b) by 609 days.

(21) Appl. No.: 16/618,613

(22) PCT Filed: Jun. 5, 2018

(86) PCT No.: PCT/US2018/036037
§ 371 (c)(1),
(2) Date: Dec. 2, 2019

(87) PCT Pub. No.: WO2018/226679
PCT Pub. Date: Dec. 13, 2018

(65) Prior Publication Data

US 2020/0179743 A1 Jun. 11, 2020

Related U.S. Application Data

(60) Provisional application No. 62/515,485, filed on Jun. 5, 2017.

(51) Int. Cl.
*A63B 21/065* (2006.01)
*A41D 1/08* (2018.01)
(Continued)

(52) U.S. Cl.
CPC ..... *A63B 21/065* (2013.01); *A41D 1/08* (2013.01); *A41D 13/0012* (2013.01);
(Continued)

(58) Field of Classification Search
CPC ..... A63B 21/065; A63B 2209/00; A63B 21/0603; A63B 21/0607; A63B 23/035;
(Continued)

(56) References Cited

U.S. PATENT DOCUMENTS 3,427,020 A 2/1969 Montour
3,490,766 A 1/1970 Gardner
(Continued)

OTHER PUBLICATIONS

"The Titin Force 8lbs Shirt System." Titin Tech. Titin Athletics, Jan. 5, 2014 (retrieved from web Jan. 26, 2017). http://shop.titintech.com/products/the-titin-force-system-variant=32289284868.
(Continued)

*Primary Examiner* — Megan Anderson
*Assistant Examiner* — Andrew M Kobylarz
(74) *Attorney, Agent, or Firm* — Lynch LLP; Sean Lynch

(57) ABSTRACT

Weighted garments are provided. In one embodiment, the garment is an arm or leg sleeve having a first section of clothing material having at least one weight positioned in a weight area of the clothing material, wherein the first section is configured to be positioned over at least a portion of an upper arm/leg of a body; a second section of clothing material configured to be positioned over an elbow/knee of the body; and a third section of clothing material having at least one weight positioned in a weight area of the clothing material, wherein the third section is configured to be positioned over at least a portion of a forearm/lower leg of the body.

18 Claims, 3 Drawing Sheets

(51) Int. Cl.
*A41D 13/00* (2006.01)
*A41D 27/10* (2006.01)
*A41D 27/20* (2006.01)

(52) U.S. Cl.
CPC ..... *A41D 13/0015* (2013.01); *A41D 27/10* (2013.01); *A41D 27/202* (2013.01); *A63B 2209/00* (2013.01)

(58) Field of Classification Search
CPC ..... A63B 24/0003; A63B 24/0062; A63B 2209/08; A63B 2209/10; A63B 2220/80; A63B 2220/833; A63B 2225/50; A41D 1/08; A41D 13/0012; A41D 13/0015; A41D 27/10; A41D 27/202; A41D 27/20
See application file for complete search history.

(56) References Cited

U.S. PATENT DOCUMENTS 4,332,379 A * 6/1982 Bannister ..... A63B 21/065 482/105
4,989,267 A 2/1991 Watson
5,010,596 A * 4/1991 Brown ..... A63B 21/065 2/238
5,033,117 A 7/1991 Fairweather
5,048,125 A 9/1991 Libertini et al.
5,176,600 A 1/1993 Wilkinson
5,659,898 A 8/1997 Bell, Jr.
5,784,716 A 7/1998 Holt et al.
5,868,652 A 2/1999 Spletzer
5,978,964 A 11/1999 Gaston
6,052,828 A * 4/2000 Widdemer ..... A41F 1/06 24/303
6,209,135 B1 * 4/2001 Irvin ..... A63B 21/065 2/102
6,289,524 B1 * 9/2001 Wright ..... A41D 13/015 2/457
6,665,879 B2 12/2003 VandenBerg
6,669,608 B1 12/2003 Winston
6,671,887 B1 * 1/2004 Eligan ..... A63B 21/065 2/228
7,090,558 B2 8/2006 Ott
8,156,572 B2 4/2012 Whaley
8,443,465 B2 5/2013 Stewart
9,301,554 B2 4/2016 Whaley
2003/0092544 A1 5/2003 Reed
2003/0130070 A1 7/2003 Nolan
2003/0208832 A1 11/2003 Vandenberg
2009/0162651 A1 * 6/2009 Rios ..... B32B 25/20 428/419
2009/0305812 A1 * 12/2009 Nakamura ..... B21K 23/00 473/331
2010/0285936 A1 * 11/2010 Tacker ..... A63B 21/0602 482/105
2011/0009713 A1 1/2011 Feinberg
2011/0043755 A1 2/2011 Gibson-Horn et al.
2011/0247127 A1 10/2011 Pou et al.
2011/0302687 A1 12/2011 Whaley
2013/0085040 A1 4/2013 Bowers
2013/0298301 A1 11/2013 Petrakis et al.
2014/0005010 A1 1/2014 Kaminsky
2014/0246499 A1 * 9/2014 Proud ..... H04Q 9/00 235/492
2015/0175313 A1 * 6/2015 Amemiya ..... B65D 33/01 383/100
2016/0310779 A1 10/2016 Porter et al.
2017/0065843 A1 * 3/2017 Foster ..... A41D 31/102
2017/0157447 A1 * 6/2017 Brown ..... A63B 21/00065
2020/0179743 A1 * 6/2020 Brown ..... A41D 27/202

OTHER PUBLICATIONS

Body Togs, "Wear Your Workout Wherever You Go", http://bodytogs.com, pp. 1-3, Oct. 26, 2015.
Brooke Dowd Sacco, "The Under Clothing Resistance Weights", http://incrediblethings.com/style-and-gear/the-under-clothing-resistance-weights/, pp. 1-2, Oct. 25, 2015.
Hyper Wear, "Hyper Vest Pro Weight Vest" https://www.hyperwear.com/hyper-vest-pro-weight-vest.html, pp. 1-4, Oct. 25, 2015.
International Search Report and Written Opinion cited in corresponding PCT application No. PCT/US18/36037; Aug. 28, 2018; 16 pp.
Kirk, Dr. David. "Size and Variability of Cast Steel Shot Particles." The Shot Peener (2009): 24-32. 2009. (retrieved from web Jan. 26, 2017). https://www.shotpeener.com/library/pdf/2009005.pdf.
Martha Stewart, "Dress Weights" http://marthastewart.com/295668/dress-weights, p. 1, Oct. 26, 2015.
Overstock, "Body Togs Wearable Leg Weights", https://www.overstock.com/Sports-Toys/Body-Togs-Wearable-Leg-Weights/2614102/product.html, pp. 1-8, May 24, 2015.
PCT International Search Report and Written Opinion of the International Searching Authority dated Apr. 7, 2017 for corresponding PCT/US 16/64996.
Rajkot, Steel Shot, Apr. 29, 2017; Retrieved from the Internet on Aug. 2, 2018, URL: https://web.archive.org/web/20170429204103/http://www.marksteelshotandgrit.com/steel-shot.html.
Rogue Fitness, "Titin Weighted Shirt Sets", http://www.roguefitness.com/titin-weighted-shirt-sets?159=110&gclid=, pp. 1-6, Oct. 25, 2015.
Top Ten Select, "Top Ten Best Weighted Arm Sleeves" http://www.toptenselect.com/ten-best-weighted-arm-sleeves/, pp. 1-10, Sep. 30, 2016.
Wear Weight "The Ultimate guide to Weighted Clothing" http://wearweight.com/weighted-clothing-guide/, pp. 1-10, Jul. 8, 2017.
Wikipedia, RTV silicone, Feb. 11, 2017, Retrieved from the Internet on Aug. 2, 2018; URL: https://web.archive.org/web/20170211223830/https://en.wikipedia.org/wiki/RTV_silicone.

* cited by examiner

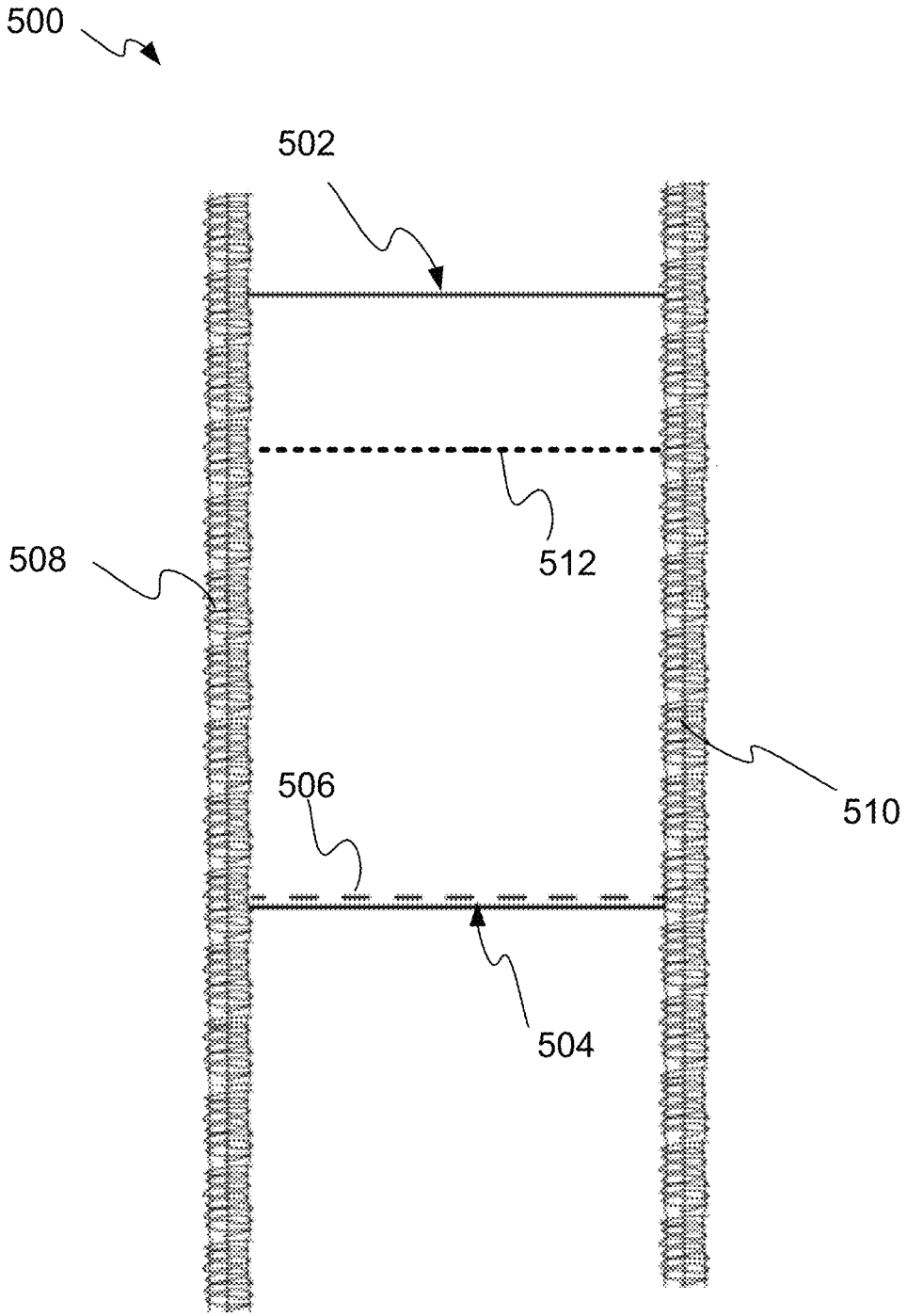
*FIG. 5*
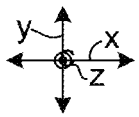

WEIGHTED CLOTHING

The present patent document is a § 371 nationalization of PCT Application Serial Number PCT/US2018/036037, filed Jun. 5, 2018, designating the United States, which is hereby incorporated by reference, and this patent document also claims the benefit of U.S. Provisional Patent Application No. 62/515,485, filed Jun. 5, 2017, which is hereby incorporated by reference in its entirety.

TECHNICAL FIELD

The following disclosure relates to weights and weighted clothing. More specifically, the following disclosure relates cosmetically hidden weighted clothing, which may be worn for physical fitness activities (e.g., resistance training) or therapy (e.g., resistance or bone density therapy).

BACKGROUND

Weighted clothing for resistance training is centered around the concept that by adding additional weight to the body when either performing fitness activities or even daily routines, the body sees an increase in calorie burning as well as an increase and development of muscle mass. Furthermore, the additional weight may slow bone density loss. In other words, the added weight, working with gravity, introduces an extra form of resistance making the overall body work harder.

Commercial examples of weighted attire (e.g., weighted vests, ankle weights, wrist weights, or weighted straps) have a variety of problems. For instance, the weighted attire may add weight in an inconsistent matter. This may create one or more comfort issues for the wearer, or cause injury to the wearer. In other examples, the weighted attire may be bulky, cumbersome or uncomfortable to wear, or difficult to fit or size to the wearer. For example, the weighted clothing may have too much weight added or too many weights positioned on the garment, adding excess bulk to the clothing or requiring the wearer of the weighted garment to work too hard.

Additionally, or alternatively, the weighted attire may not be cosmetically attractive (e.g., a person may not consider wearing the weighted attire during their daily activities outside of a gym or workout session).

Therefore, there is a continued need for improved weighted clothing or garments that may be comfortable to wear, not bulky or cumbersome (e.g., not overwhelming in the number or amount of weight added), and/or cosmetically attractive (e.g., concealed weights).

SUMMARY

Embodiments of weighted clothing are provided herein. In one embodiment, an arm sleeve is provided. The arm sleeve has a first section of clothing material having at least one weight positioned in a weight area of the clothing material, wherein the first section is configured to be positioned over at least a portion of an upper arm of a body; a second section of clothing material configured to be positioned over an elbow of the body; and a third section of clothing material having at least one weight positioned in a weight area of the clothing material, wherein the third section is configured to be positioned over at least a portion of a forearm of the body.

In another embodiment, a leg sleeve is provided. The leg sleeve has a first section of clothing material having at least one weight positioned in a weight area of the clothing material, wherein the first section is configured to be positioned over at least a portion of an upper arm/leg of a body; a second section of clothing material configured to be positioned over an elbow/knee of the body; and a third section of clothing material having at least one weight positioned in a weight area of the clothing material, wherein the third section is configured to be positioned over at least a portion of a forearm/lower leg of the body.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

For a more complete understanding of the disclosure, reference is made to the following detailed description and accompanying drawing figures, in which like reference numerals may be used to identify like elements in the figures.

FIG. 5 depicts an example of an internal pocket for securing a weight.

Figure 1:
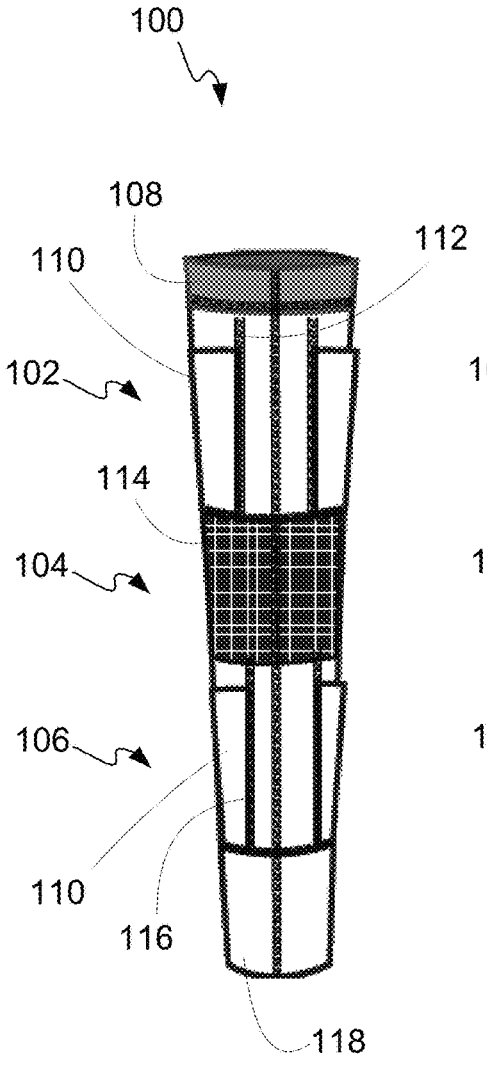
FIG. 1 depicts an example of a weighted arm sleeve.

While the disclosed devices, systems, and methods are representative of embodiments in various forms, specific embodiments are illustrated in the drawings (and are hereafter described), with the understanding that the disclosure is intended to be illustrative and not limit the claim scope to the specific embodiments described and illustrated herein.

DETAILED DESCRIPTION

Adding resistance to a person's daily routine or daily physical fitness activity may increase their calorie burn and/or build muscle. Through use of the weighted clothing, or through additional use of weighted clothing, a wearer may be able to improve the wearer's personal, health, or endurance goals. For example, the weighted clothing may allow a wearer to maintain, tone, or improve the wearer's muscle mass, overall performance and strength, caloric burn, and/or bone density.

Exemplary embodiments are provided for cosmetically concealing weights within or on a surface of an article of clothing (i.e., garment). A weighted garment may be useful for any number of activities or everyday use, including but not limited to physical fitness activities, sports training, weight loss, weight training, or rehabilitation. Furthermore, because the weights are cosmetically concealed within or on the garment, a wearer of the garment may be more inclined to wear the garment on a more routine basis (e.g., a daily basis), instead of just within a gym or training setting.

One advantage of the weighted clothing examples disclosed herein is that the weights added to the garment are sized and/or positioned in areas on the garment to be unobtrusive to the wearer and cosmetically concealed from view. The weights are unobtrusive in that the weight is not bulky or protruding from the clothing too much, and the amount of weight is configured to provide the added training/health benefits without requiring the wearer to exercise excessively hard (e.g., the wearer may not realize that there has been weight added to the garment in comparison with a weight-free garment of similar design).

Clothing Material

The weighted clothing or garment may be made of any number of different materials. For example, the material may be a natural or synthetic material, such as cotton, nylon, polyester, polyurethane, elastic polyester-polyurethane copolymers (e.g., "spandex"), or combinations and blends thereof.

The weighted clothing may be configured for any number of different uses. For example, the clothing may be configured as athletic or workout clothing (e.g., moisture-wicking or form-fitting apparel), casual clothing (e.g., t-shirts or jeans), or work clothing (e.g., dress pants or shirts). The clothing may be one out of a variety of different configurations or shapes.

In certain examples, the weighted clothing is an arm sleeve. The arm sleeve may be configured to be positioned over at least a portion of the upper arm, the elbow, and at least a portion of the forearm.

In other examples, the weighted clothing is a leg sleeve. The leg sleeve may be configured to be positioned over at least a portion of the upper leg, the knee, and at least a portion of the lower leg.

In yet other examples, the weighted clothing is an undergarment (e.g., underwear). The undergarment is configured to be worn as a base layer of clothing, worn beneath a shirt, shorts, pants, leggings, or the like.

The weighted garment may be a form-fitting garment that tightly follows the contours of the part of the body being covered. For example, a form-fitting garment may have a majority (>50%) of the garment in close proximity to the wearer's body (e.g., <2 mm, <1 mm) when worn. The material used for a form-fitting garment may be a synthetic fiber, flexible/stretchable material such as spandex, or a combination of various compositions.

Positioning of Weights

The weighted clothing may include one or more weight areas provided within or on a surface of the garment. Each weight area may have one or more individual weights. Alternatively, a plurality of weights may be provided in one or more weight areas.

In certain examples, one or more weights are provided in a circumference around an opening in the garment such an arm opening of an arm sleeve, a leg opening of a leg sleeve, or around the waist of an undergarment (e.g., boxers, briefs, panties, or other underwear). In some examples, a plurality of weights may be positioned in a "balanced" configuration around the circumference of an opening in the garment such that the weights are equally spaced apart. This may be advantageous as balanced weights for a particular location may allow for the garment to be worn without the weights shifting the clothing in a particular direction. That is, balanced weights may not pull or draw the clothing unevenly. Additionally, equally spaced or balanced weights may provide the feeling of a single weight positioned around the circumference of the garment opening without having to construct, shape, and fit a single weight for the garment opening.

In alternative examples, a plurality of weights may be positioned in an "unbalanced" configuration at a particular location of the clothing. An "unbalanced" configuration may refer to the placement of a higher percentage of the individual weights of the plurality of weights in one area and a lower percentage of individual weights of the plurality of weights in another area of the weight area. For example, a configuration of a plurality of weights may be unbalanced where all of the weights of a plurality of weights are positioned on one side of an arm or leg sleeve, while the opposite side of the arm/leg sleeve has no weights. For instance, a plurality of weights may be provided at or near one end of an arm sleeve such that the weights do not encircle the clothing area near the opening of the arm sleeve. In such an example, all of the weights of a plurality of weights may be on the visible side of an arm sleeve furthest from the body, while the non-visible side (closer to the arm pit and closest to the body) has no weights. This may be advantageous, as it may be more comfortable for the weight to not rest against inner side of the arm and potential press into the body/rib cage. In another example of an unbalanced configuration, a majority of the weights may be on one side of an opening and a minority of weights may be on the opposite side of the opening (e.g., leg sleeve). This may be advantageous, as the weights may be positioned in specific areas of the wearer's body (e.g., leg) to provide a comfortable feel to the wearer.

The positioning of the weight may also be based on a targeted muscle group. For example, the positioning of the weights may provide resistance to one or more key muscle group in the legs, arms, or shoulders (e.g., glutes, quadriceps, hamstrings, calves, biceps, triceps, brachioradialis, pectorals, trapezius, or deltoids). This may result in increased muscular strength, endurance, and tone in the targeted muscles.

In certain examples, the weight is positioned in the garment to at least partially cover the targeted muscle group (e.g., be positioned over the "belly" of the muscle). A weight may be positioned in a leg sleeve such that the weight is on top of or covering a calf muscle, quadricep muscle, or hamstring muscle. Similarly, a weight may be positioned in an arm sleeve such that the weight is on top of or covering a bicep, tricep, or brachioradialis muscle. This may be advantageous in providing added resistance to the body while limiting changes in the biomechanics of the body.

With regard to leg sleeve garments or undergarments, in certain examples, one or more weights may be positioned in each thigh area of the garment. In other examples, one or more weights may be positioned in a calf area of a leg sleeve garment. In certain examples, weights may be positioned in both the thigh and calf areas of a leg sleeve garment.

With regard to arm sleeve garments, in certain examples, one or more weights may be positioned in each upper arm area of the arm sleeve garment. In other examples, one or more weights may be positioned in a forearm area of the arm sleeve garment. In certain examples, weights may be positioned in both the upper arm and forearm areas of an arm sleeve garment.

Each weight may be secured within between layers of a garment, on an inner surface of the garment, or on an outer surface of the garment. In some examples, the weight may be secured between two layers of clothing material (e.g., an inner layer and an outer layer). This arrangement may be advantageous as the inner clothing layer protects the weight from direct contact with the skin of the wearer while the outer clothing layer conceals the weight from view. The material of the outer layer may be the same as the material of the inner layer. Alternatively, the outer layer material may be a different material from the inner layer material.

In some examples, the weight is positioned within a pocket created by various layers of the garment. The pocket may be an internal pocket such that the pocket opening is adjacent to the wearer of the garment. Alternatively, the pocket may be an external pocket having a pocket opening on the outside of the garment. The opening may allow for a removable weight. For example, the opening may include a flap of garment material that visibly covers the opening, but may be moved to access the opening and add or remove a weight. Alternatively, the pocket may be permanently closed after the weight has been added to the pocket (e.g., the opening may be stitched closed).

In certain examples, the weight may be positioned near, adjacent to, or within a hemline of the garment. For example, the hemline of an arm or leg sleeve may secure one or more weights between the inner layer of the arm or leg sleeve and the outer layer of the arm or leg sleeve forming the hemline. This may be advantageous as the weight is cosmetically concealed from view in an area of the clothing that is being altered to form the hemline. In some examples, the weight is configured to be positioned within 1 cm, 2 cm, 3 cm, 4 cm, or 5 cm of the hemline of the garment.

In some examples, a weight may be positioned at, near, or adjacent to a seam or stitching in the garment. For example, the weight may be positioned between an inner and outer layer of clothing material at a seam line (e.g., a seam line running up the side of a pant leg). This may be advantageous as the weight is cosmetically concealed from view in an area of the clothing that is being altered to form the seam line. In some examples, the weight is configured to be positioned within 1 cm, 2 cm, 3 cm, 4 cm, or 5 cm of the seam line of the garment.

In certain examples, one or more weights may be positioned within a certain distance of a joint of the body of the wearer. The weight may be positioned in the arm or leg sleeve of the garment within a certain distance of the elbow or knee joint, respectively, when the garment is worn. In some examples, the weight is configured to be positioned at least 1 cm, 2 cm, 3 cm, 4 cm, 5 cm, 10 cm, or 20 cm from the elbow or knee joint when the garment is worn (as defined as the closest distance between a portion of the weight and the edge of the joint). In other examples, the weight is configured to be positioned at a distance of 1-20 cm, 5-10 cm, 5-20 cm, 1-10 cm, or 1-5 cm from the elbow or knee joint when the garment is worn. This may be advantageous in providing added resistance to the body while limiting changes in the biomechanics of the body.

Fixed or Removable Weights

The weights within the weighted clothing may be removable or fixed in place. In some examples, the weights are fixed in place. For example, a weight may be inserted between two layers of clothing material and permanently secured in place. Each weight may be secured in place by stitching the adjacent layers of clothing material around the perimeter of the weight. Alternatively, a weight may be affixed to a clothing layer by an adhesive material. Fixing the weight in place in the garment is advantageous as each weight is immobile and avoids inadvertent movement during use.

In alternative examples, the weights are removable from the garment. This is advantageous as it allows for easier cleaning of the garment (i.e., no added cleaning steps if the weights are removable while a garment bag may be helpful to wash or dry the weighted clothing with fixed/non-removable weights). Pockets may be stitched or provided on a layer of the garment or between layers to secure each weight. The pockets may have one edge open for access to the weight or weight area. In some examples, a pocket may have at least one edge openable by a zipper or hook and loop fastener fabric (e.g., Velcro). This may be advantageous as the openable edge allows the option for the wearer to add or remove one or more weights from a weight area when the wearer would like to change his/her training goals, wash the clothing, and so on.

The pocket may include a flap or layer of material that conceals the opening of the pocket, but may be movable to access the opening and add or remove a weight. In some examples, the opening of the pocket may be the width of the weight or slightly wider than the width of the weight (therein allowing the weight to be inserted into the pocket). The base of the pocket (opposite the opening of the pocket), may also have a width equal to the width of the weight. Alternatively, the width of the base of the pocket may be less than the width of the weight, therein restricting movement of the weight at the base or near the base of the pocket. In some examples, a layer of stitching is provided at the base of the pocket to assist in restricting movement of the weight at or near the base of the pocket.

In certain examples, an internal surface of the pocket (i.e., a surface configured to abut the insertable weight) may have an adhesive material applied on the surface. In other, alterative examples, a surface of the weight may have an adhesive material or layer applied on its surface. This may be advantageous in stabilizing or securing the weight in place, particularly during strenuous activity.

In certain examples, the adhesive material is placed on one internal surface of the pocket. In other examples, the adhesive material is placed on two, opposing internal surfaces of the pocket material to secure opposing sides of the insertable weight. In yet additional examples, the adhesive material is placed on one surface of the weight. In another example, the adhesive material is placed on two, opposing surfaces of the weight. In yet another example, the adhesive material is placed on at least one internal surface of the pocket and on at least one surface of the weight.

The adhesive material may be any type of adhesive material configured to grip or secure the weight in place. The adhesive material may an elastomer, thermoplastic, emulsion, and thermoset. For example, the adhesive may be a polyurethane resin, polyester resin, epoxy resin, or a combination thereof.

In some examples, one or more magnetic weights may be positioned in place between layers of the garment (either removable or fixed in place). Additional weights may be attachable and removable from the magnets at an outer surface of the garment, wherein a garment layer separates the internal magnetic weight and the external, added weight. For example, piping (e.g., metal fibers forming a rope) may be made of a magnetic material that may be secured to an outer layer of the garment via magnets embedded between layers of the garment. This is advantageous as the internal magnetic weight provides a first amount of weight for a baseline workout or therapy session, while the additional, external weight provides a second amount of weight that may be added for a more strenuous workout or therapy session. This variability may be beneficial for certain users. Additionally, a person may be able to more easily put on the garment with only the internal magnetic weight and then place the second external weight on afterward, in comparison with another weighted garment having the same total amount of added weight all internally secured between the two layers of the garment.

Composition, Configuration, and Amount of Weights

The material of each weight in the weighted clothing may be one or more separate compositions. In certain examples, each weight is made of a metal or metal alloy. Certain non-limiting examples of metals or metal alloys include iron, lead, copper, tin, zinc, tungsten, steel, nickel, cobalt, rare earth metal alloys, or combinations thereof In other examples, the weight is composed of a non-metal or non-metal alloy. Non-limiting examples include carbon, graphite, or graphene. In some examples, an individual weight may include a plurality of smaller weighted objects (e.g., a plurality of pellets, granulated metals, or sand). In other examples, an individual weight may be a rope having a plurality of threaded fibers (e.g., metal fibers). In certain examples, an individual weight may be made of a gel, rubber, plastic, thermoplastic elastomer (e.g., styrene block copolymer such as styrene-butadiene-styrene), or ethylene-propylene copolymer.

In certain examples, the weight includes a plurality of pellets made of a metal or metal alloy. In one example, the metal is steel. The steel may be a plurality of a steel shots (e.g., rounded or angular shots) or steel grit. The size of the pellets (e.g., steel shots or grit) may be variable. For example, the pellets or steel shots may be S70 (having a diameter of 0.0049"-0.0165" or 0.124-0.419 mm), S110 (0.0070"-0.0232" or 0.178-0.589 mm), S170 (0.0138"-0.0331" or 0.351-0.841 mm), S230 (0.0197"-0.0394" or 0.500-1.001 mm), S280 (0.0232"-0.0469" or 0.589-1.191 mm), S330 (0.0280"-0.0555" or 0.711-1.410 mm), S390 (0.0331"-0.0661" or 0.841-1.679 mm), S460 (0.0394"-0.0787" or 1.001-1.999 mm), S550 (0.0469"-0.0787" or 1.191-1.999 mm), S660 (0.0555"-0.0937" or 1.410-2.380 mm), or S780 (0.0661"-0.1110" or 1.679-2.819 mm). In one particular example, the steel shots are S70 steel shots.

The plurality of pellets (e.g., steel shots) may be combined with one or more additional components to form the weight. In some examples, the additional component may be an additional metal (e.g., copper metal or copper alloy). Additionally, or alternatively, the additional component may be an adhesive composition configured to bond or otherwise secure the plurality of pellets together. The adhesive composition may be a non-reactive adhesive composition such as a drying adhesive (e.g., glue or rubber cement), a pressure-sensitive adhesive (e.g. An acrylate-based polymer), contact adhesive (e.g., rubbers or polychloroprene), or hot adhesive (e.g., ethylene-vinyl acetate). In other examples, the adhesive composition may be a reactive adhesive such as a multi-component adhesive or an ultraviolet light curing adhesive, heat curing adhesive, or moisture curing adhesive. Additional non-limiting examples of adhesives include elastomers, thermoplastics, emulsions, and thermosets. For example, the adhesive may be a polyurethane resin, polyester resin, epoxy resin, or a combination thereof In one particular example, the adhesive composition is a room temperature vulcanization (RTV) silicone rubber composition.

In certain examples, the plurality of pellets (e.g., steel shots) is 1-99 wt. %, 50-99 wt. %., 60-90 wt. %, 70-90 wt. %, or 80-85 wt. % of the weight. The adhesive compound is 1-99 wt. %, 1-50 wt. %, 5-20 wt. %, or 8-17 wt. % of the weight.

A remainder of the weight may be formed from additional components. In one example, an additional component includes a sealing or encapsulation layer configured to secure the plurality of pellets and adhesive composition. The encapsulation layer may be a strong but flexible material configured to allow the weight to bend or curve around a wearer's body, while not being susceptible to puncture or tearing during typical use. For example, the sealing or encapsulation layer may be a polymer composition such as a plastic. The polymer may be a thermoplastic or a thermosetting polymer. Thermoplastic compositions include polyethylene, polypropylene, polystyrene, or polyvinyl chloride resins. In another example, the polymer is a polyamide (e.g., nylon) composition, polymethyl methacrylate, or rubber. In one example, the encapsulation layer is a polyvinyl chloride resin. The encapsulation layer may be 0.1-20 wt. %, 1-10 wt. %, or 3-7 wt. % of the weight.

In certain examples, the weight may be formed by placing a plurality of pellets within a container or mold. The adhesive composition may be injected, added, or otherwise mixed with the plurality of pellets in the container or mold. Heat may be added or applied to harden the adhesive to the plurality of pellets. A sealant or encapsulation layer may be applied or wrapped around the pellet/adhesive combination.

In some examples, one or more of the individual weights are made of a magnetic composition (e.g., compositions having iron, nickel, cobalt, and/or rare earth metal alloys). In other examples, one or more weights are composed of a malleable, moldable, or flexible composition. The malleable or flexible composition may be a metal such as iron, aluminum, or lead. Alternatively, the flexible or moldable composition may be a thermoplastic polymer composition. In some examples, the metal may be made of a flexible composition such as a thermoplastic polymer with metal inserts embedded within the flexible material. These malleable or flexible compositions may be advantageous as the weight may be formed into a ring that matches with a circumference of the opening in the garment.

In one particular example, the composition of a weight has a density of at least 15, 20, or 25 grams per cubic centimeter. For example, a tungsten metal or metal alloy may have a density of at least 15 g/cc. This may be advantageous as a higher density composition allows for more weight to be provided within a defined volume (in comparison with lower density material). This may provide for thinner weights provided on or within the weighted clothing (i.e., the same amount of weight as a lower density material in less volume) or a larger amount of weight to be provided within a defined volume when compared with the lower density material.

The size or shape of each weight within the weighted clothing is variable. For example, the height, width, radius, depth or thickness, circumference, or perimeter of each individual weight is variable. The height and width of a weight may be measured along the vertical and horizontal directions of the garment when worn by the wearer, respectively. The depth or thickness of a weight is measured in a direction from the wearer's body extending outward, perpendicular to the plane in which the garment lies on the body.

Various weight shapes are possible. For example, a weight may have three-dimensional shape in the form of a cuboid or cylinder. The three-dimensional shape may also be flexible or curved in certain areas to match the curve of the garment, or the wearer of the garment. As viewed two-dimensionally (ignoring the depth/thickness dimension of the weight), the weight may be shaped in a form of a quadrilateral (e.g., rectangle, square), triangle, circle, oval, or another polygon.

The shape and the size of the weight may be determined based on the location of the weight or weight area of the garment. In certain examples, different sized and different shaped weights are provided within the garment or within a single weight area of the garment. In some examples, a weight has a two-dimensional shape of a rectangle, wherein the length and width of the rectangle are in a range of 0.1-1000 mm, 1-100 mm, or 1-10 mm. In certain examples, the dimensions of the length/width of the weight are 25-55 mm, 25-80 mm, 25-155 mm, 50-55 mm, 50-80 mm, 50-155 mm, or 75-155 mm In other examples, the weight has a two-dimensional shape of a circle, wherein the radius of the circle is in a range of 0.1-500 mm, 1-50 mm, or 1-5 mm.

For the weights to be cosmetically concealed within the garment, the thickness of the weight may be configured to be as small as possible while still providing a minimum amount of weight capable of providing some benefit for physical fitness activities (e.g., resistance training) or therapy (e.g., resistance or bone density therapy). Because it may be easier to cosmetically conceal the weight in a looser fitted garment, the thickness of the weight may be larger in comparison with a form-fitted garment. In certain examples, the height, width, radius, circumference, or perimeter dimensions of each individual weight may vary based on the type of clothing and the positioning of the weight within the garment.

In certain examples, the depth or thickness of an individual weight is in a range of 0.1 mm-50 mm, 0.1 mm-20 mm, 0.1 mm-10 mm, 5 mm-10 mm, 0.1-5 mm, 1-5 mm, or 1-3 mm. In one example, the thickness of the weight is approximately 6.4 mm. Alternatively, the depth/thickness of an individual weight is less than 50 mm, less than 20 mm, less than 10 mm, less than 5 mm, less than 4 mm, less than 3 mm, less than 2 mm, or less than 1 mm.

The amount of added weight by the individual weights in the garment is variable. In certain examples, each individual weight is in a range of 0.01-10 kg, 0.01-0.1 kg, 0.1-5 kg, or 0.1-1 kg. In some examples, the weight area having a plurality of individual weights is in a range of 0.01-10 kg, 0.1-5 kg, or 0.1-1 kg. In certain examples, each weight is approximately 0.06 kg, 0.17 kg, or 0.23 kg.

In certain examples, the weights are cosmetically concealed within the garment when the weight, after being secured between two clothing layers of the garment, does not cause the garment to bulge outward from the body of the wearer at the location of the weight. For example, the weight is cosmetically concealed when the bulge is less than 20 mm, 10 mm, 5 mm, 3 mm, or 1 mm. The bulge may be measured by examining the thickness of the garment at the weight location versus the thickness of the garment at a nearby location with no weight present (as measured in a direction from the wearer's body extending outward, perpendicular to the plane in which the garment lies on the body).

In certain examples, multiple weight areas are provided within the garment(s). The weight areas may be balanced, where reciprocal weight areas (e.g., a first leg sleeve and a second leg sleeve or a first arm sleeve and a second arm sleeve) have the same overall weight added. In other examples, the reciprocal weight areas are unbalanced, where one weight area has a larger added weight from the second weight area.

"Smart" Weights and Weighted Clothing

In some examples, the weighted clothing may include an electronic device configured to monitor and report athletic activity. In certain examples, the electronic device or a portion of the electronic device is embedded within or on a surface of one or more weights. Alternatively, or additionally, an electronic device or a portion of the electronic device is attached to a surface of the garment material or embedded between two layers of the garment.

The electronic device may include an electrode, such as an electromyography (EMG) surface electrode. Electromyography (EMG) is an electrodiagnostic medicine technique for recording and measuring the electrical activity produced by the muscles. EMG is captured or performed by using an electromyograph. This produces a record called an electromyogram. The electromyograph receives the electric potential generated by the muscles when they are electrically activated. The signals can be analyzed to detect either abnormalities, activity levels, recruitment order, and analyze the biomechanics of the body movement.

The EMG surface electrode may be positioned on a surface of the weight or clothing layer (e.g., abutting the weight) such that the electrode is positioned near or directly on the wearer's skin/body. This may be advantageous in analyzing the athletic performance of the wearer (e.g., by monitoring electronic activity in the muscle positioned adjacent to the EMG surface electrode). In other words, data may be collected to monitor how the wearer is functioning with the weighted clothing, what capacity of athletic performance the wearer is at, how much harder the wearer may be able to work, and so on.)

The electronic device may include one or more processing units, which may be individually or collectively referred to herein as a processor or integrated circuit. The processor may include integrated memory and/or be in communication with system memory. The processor may be a specialized microprocessor, such as a digital signal processor (DSP), a very long instruction word (VLIW) processor, or other microcontroller, or may be a general-purpose central processing unit (CPU) having one or more processing cores. The processor, the system memory, and/or any other components of the computing environment may be packaged or otherwise integrated as a system on a chip (SoC), application-specific integrated circuit (ASIC), or other integrated circuit or system.

The EMG surface electrodes may be in communication with one or more processors of the electronic device. The electronic device may be connected over a communication network with a separate electronic device (e.g., a mobile phone or tablet computer of the wearer) to provide the collected data. The "communication network" may refer to any wireless communication path between the connected electronic devices. In certain examples, the communication network may be a personal area network (PAN), a near-me area network (NAN), or a local area network (LAN). In some examples, the communication network includes communication via radio wave frequencies. In one particular example, the communication network includes Bluetooth low energy (BLE) technology or a comparable technology configured to transmit small packets of information (as compared with Bluetooth Classic technology).

Exemplary Clothing Embodiments

Figure 2:
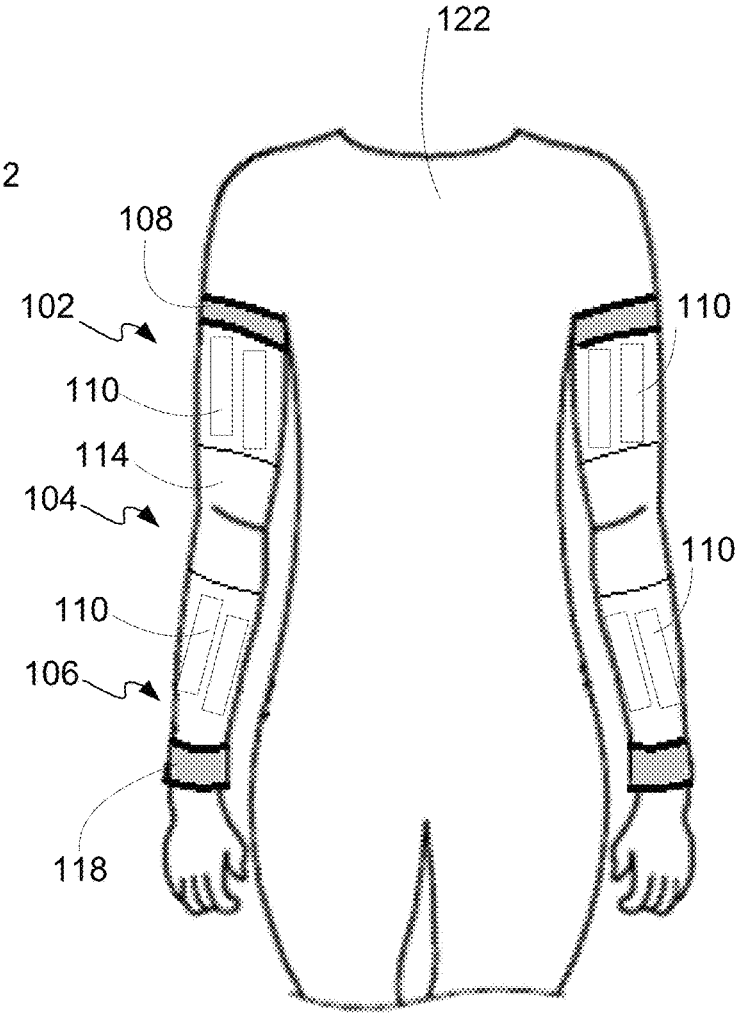
FIG. 2 depicts an example of weighted arm sleeves on a body.

FIGS. 1-5 illustrate non-limiting examples of the weighted clothing features described above. FIG. 1 depicts an example of a weighted arm sleeve 100. FIG. 2 depicts an example of the weighted arm sleeve of FIG. 1 positioned on a body 122.

As depicted in FIGS. 1 and 2, the arm sleeve 100 includes three sections. A first section 102 is configured to be positioned over a portion of an upper arm of a wearer. A second section 104 is configured to be positioned over an elbow area of the wearer. A third section 106 is configured to be positioned over a portion of a forearm of the wearer.

The first section 102 includes a gripper or stretchable elastic area 108 configured to firmly secure the end of the arm sleeve to an appropriate location on the wearer of the body (e.g., near a shoulder, adjacent to an arm pit). The first section 102 also includes at least one weight area 110 having at least one weight positioned within the weight area 110. The weight in the weight area 110 may be secured in place by at least one hemline 112 adjacent to the weight area 110. The positioning of a plurality of weight areas in the first section 102 is configurable based on the locations of the targeted muscles or comfort for the wearer (as discussed above).

The second section 104 includes a breathable and/or stretchable clothing material 114 (e.g., a mesh fabric). This is advantageous in allowing the area near the elbow to breath and move without restrictions from weight.

The third section 106 includes an additional gripper or stretchable elastic cuff area 118 configured to firmly secure the end of the arm sleeve to an appropriate location on the wearer of the body (e.g., near the wrist). The third section 106 also includes at least one weight area 110 having at least one weight positioned within the weight area 110. Similar to the first section 102, the weight in the weight area 110 of the third section 106 may be secured in place by at least one hemline 116 adjacent to the weight area 110. Additionally, the positioning of a plurality of weight areas in the third section 106 is configurable based on the locations of the targeted muscles or comfort for the wearer (as discussed above).

The first section 102, second section 104, and third section 106 may be made out of a same or different clothing material or design. In some examples, the first section 102 and third section 106 are made of a similar clothing material or design, while the intermediate, second section 104 is made of a different clothing material or design. As noted above, the second section 104 may be made of a breathable fabric material (e.g., a mesh material) that differs from the material used within the first section 102 and/or third section 106.

Figure 3:
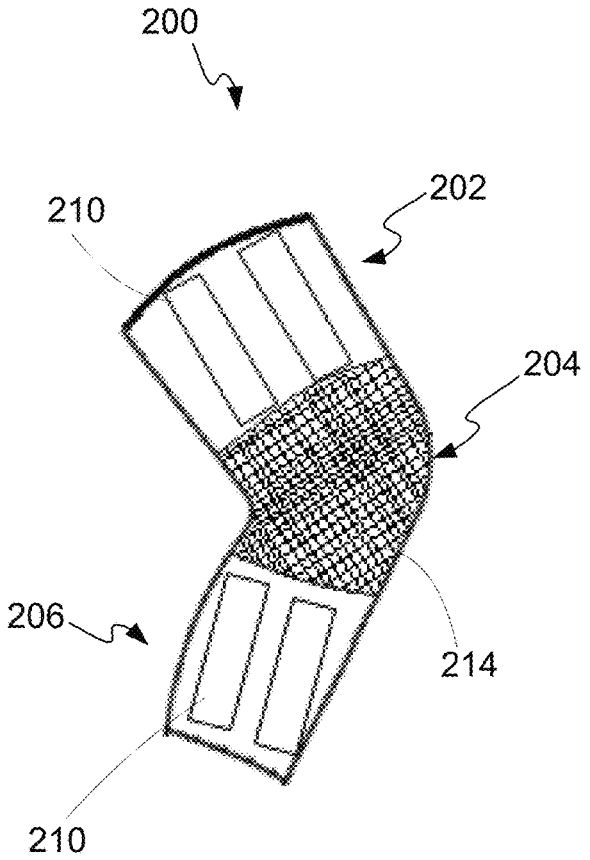
FIG. 3 depicts an example of a weighted leg sleeve.
Figure 4:
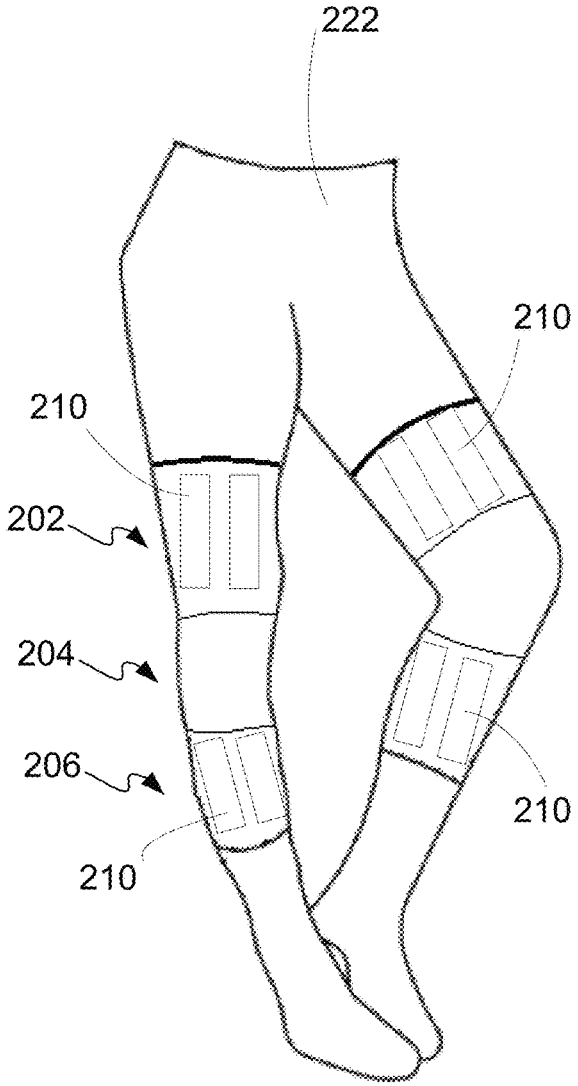
FIG. 4 depicts an example of weighted leg sleeves on a body.

FIG. 3 depicts an example of a weighted leg sleeve 200. FIG. 4 depicts an example of the weighted leg sleeve of FIG. 3 positioned on a body 222.

As depicted in FIGS. 3 and 4, the leg sleeve 200 includes three sections. A first section 202 is configured to be positioned over a portion of an upper arm of a wearer. A second section 204 is configured to be positioned over an elbow area of the wearer. A third section 206 is configured to be positioned over a portion of a forearm of the wearer.

The first section 202 may include a gripper or stretchable elastic area configured to firmly secure the end of the leg sleeve to an appropriate location on the wearer of the body (e.g., near the upper thigh area). The first section 202 also includes at least one weight area 210 having at least one weight positioned within the weight area 210. The weight in the weight area 210 may be secured in place by at least one hemline adjacent to the weight area 210. The positioning of a plurality of weight areas in the first section 202 is configurable based on the locations of the targeted muscles or comfort for the wearer (as discussed above).

The second section 204 includes a breathable and/or stretchable clothing material 214 (e.g., a mesh fabric). This is advantageous in allowing the area near the knee to breath and move without restrictions from weight.

The third section 206 may include an additional gripper or stretchable elastic cuff area configured to firmly secure the end of the arm sleeve to an appropriate location on the wearer of the body (e.g., near the ankle). The third section 206 also includes at least one weight area 210 having at least one weight positioned within the weight area 210. Similar to the first section 202, the weight in the weight area 210 of the third section 206 may be secured in place by at least one hemline adjacent to the weight area 210. Additionally, the positioning of a plurality of weight areas in the third section 206 is configurable based on the locations of the targeted muscles or comfort for the wearer (as discussed above).

The first section 202, second section 204, and third section 206 may be made out of a same or different clothing material or design. In some examples, the first section 202 and third section 206 are made of a similar clothing material or design, while the intermediate, second section 204 is made of a different clothing material or design. As noted above, the second section 204 may be made of a breathable fabric material (e.g., a mesh material) that differs from the material used within the first section 202 and/or third section 206.

FIG. 5 depicts an example of an internal pocket 500 for securing a weight. The pocket 500 includes an opening 502 at one end, and a base 504 at an opposite end. A layer of stitching 506 is provided at the base of the pocket to assist in restricting movement of the weight at or near the base of the pocket. The pocket 500 is enclosed on the sides between the opening 502 and the base 504 by stitching 508, 510 or hemming The stitching 508, 510 may be a flat lock stitch or a whipstitch top stitching, wherein multiple thread flat stitches are used to secure and support the weight. This may be advantageous as the garment may be configured with no seam allowance with layers folding to the underside. There may be no seam allowance because the cut edges of the fabric of the garment are butted together and joined flat in a single layer with thread. Using flat lock stitching may also reduce chafing. Flat lock stitching also provides a durable stitch technique for compression fabrics.

The pocket 500 includes an overlay flap 512 configured to conceal the opening 502. The flap 512 or layer of material that conceals the opening of the pocket may be movable to access the opening 502 and add or remove a weight. The flap 512 may extend less than the entire length of the pocket 500 (as measured in the y-direction).

In some examples, the width of the opening 502 of the pocket (as measured in the x-direction in FIG. 5) may be equal to width of the weight to be inserted. Alternatively, the width of the opening 502 of the pocket may be slightly wider than the width of the weight (therein allowing the weight to be readily inserted into the pocket).

The base 504 of the pocket may also have a width (as measured in the x-direction in FIG. 5) equal to the width of the weight. Alternatively, the width of the base 504 of the pocket may be less than the width of the weight, therein restricting movement of the weight at the base 504 or near the base of the pocket. In some examples, the width of the base 504 of the pocket is less than the width of the opening of the pocket (e.g., the width may taper toward the base).

The length of the pocket (as measured in the y-direction in FIG. 5) may be configured to be equal to the length of the weight to be inserted. Alternatively, the length may be slightly greater than the length of the weight to readily accommodate the weight within the pocket.

The pocket may be tailored based on each weight size and the location on the body the weight resides. The pocket orientation may be configurable based on weight sizes, body size, and the type of stress the fabric can take.

As used herein, the singular forms "a," "an," and "the" include plural referents unless the context clearly dictates otherwise.

As used herein, "for example," "for instance," "such as," or "including" are meant to introduce examples that further clarify more general subject matter. Unless otherwise expressly indicated, such examples are provided only as an aid for understanding embodiments illustrated in the present disclosure, and are not meant to be limiting in any fashion. Nor do these phrases indicate any kind of preference for the disclosed embodiment.

As used herein, the discussion presumes a constant gravitational field, wherein the weight of an object is proportional to its mass—and the terms "weight" and "mass" are herein interchanged.

As used herein, the phrase "adjacent to" may refer to a close proximity of one object to another. For example, a first object may be adjacent to a second object if the objects are abutting or touching each other, or the first object is within 1 mm, 5 mm, 1 cm, or 10 cm of the second object.

While the present claim scope has been described with reference to specific examples, which are intended to be illustrative only and not to be limiting of the claim scope, it will be apparent to those of ordinary skill in the art that changes, additions and/or deletions may be made to the disclosed embodiments without departing from the spirit and scope of the claims.

The foregoing description is given for clearness of understanding only, and no unnecessary limitations should be understood therefrom, as modifications within the scope of the claims may be apparent to those having ordinary skill in the art.

The invention claimed is:

1. An arm sleeve comprising:

a first section of clothing material having a first pocket;

a first weight positioned in the first pocket, wherein the first section is configured to be positioned over at least a portion of an upper arm of a body;

a first adhesive disposed on two internal opposing surfaces of the first pocket that is configured to hold the first weight in place;

the first section comprising a first gripper configured to hold the arm sleeve near an armpit of the upper arm;

a second section of the clothing material having a second pocket;

a second weight positioned in the second pocket, wherein the second section is configured to be positioned over at least a portion of a forearm of the body;

a second adhesive disposed on two internal opposing surfaces of the second pocket that is configured to hold the second weight in place;

the second section comprising a second gripper configured to hold the arm sleeve near a wrist of the forearm; and a third section of the clothing material comprising a stretchable clothing material. wherein the third section is configured to be positioned over an elbow of the body, wherein the third section of the clothing material couples with both the first section and the second section.

2. The arm sleeve of claim 1, wherein the first pocket and second pocket are positioned between a first layer and a second layer of the clothing material.

3. The arm sleeve of claim 2, wherein the first layer is stitched to the second layer around a perimeter of the first weight, securing the first weight within the first pocket.

4. The arm sleeve of claim 1, wherein an opening width of the first pocket is wider than a base width of the first pocket.

5. The arm sleeve of claim 4, wherein at least one of the first weight and the second weight further comprises an encapsulation layer configured to surround a metal or a metal alloy.

6. The arm sleeve of claim 1, wherein the first pocket and the second pocket are stitched shut.

7. The arm sleeve of claim 1, wherein the first weight comprises a magnetic material and further comprising at least one magnetic weight configured to couple with the first weight from an exterior surface of the arm sleeve.

8. The arm sleeve of claim 1, wherein the first pocket is positioned on the arm sleeve on a side farthest from the body.

9. The arm sleeve of claim 1, wherein the first pocket is positioned to on the arm sleeve such that the first weight adds resistance to bicep movements when the arm sleeve is worn.

10. The arm sleeve of claim 1, wherein the first pocket comprises a flap of clothing material configured to conceal an opening in the first pocket, and wherein the flap is movable to access the opening.

11. The arm sleeve of claim 1, wherein the first and second weights comprise a flexible thermoplastic polymer with embedded metal inserts.

12. The arm sleeve of claim 1, wherein at least one of the first weight and the second weight is cosmetically concealed between a first layer and a second layer of the clothing material such that, when the arm sleeve is worn on the body, any outward bulge created by either the first weight or the second weight the weight is less than 2 cm, wherein the bulge is measured in a direction from the body extending normally outward.

13. The arm sleeve of claim 1, wherein the first weight is configured to be positioned within at least 5 cm of the elbow of the body when the arm sleeve is worn.

14. A leg sleeve comprising:

a first section of clothing material having a first pocket;

the first section comprising a first gripper configured to hold the leg sleeve on an upper leg of a body:

a first weight positioned in the first pocket, wherein the first section is configured to be positioned over at least a portion of the upper leg of the body;

a first adhesive disposed on two internal opposing surfaces of the first pocket that is configured to hold the first weight in place;

a second section of the clothing material having a second pocket;

the second section comprising a second gripper configured to hold the leg sleeve near an ankle of a lower leg; and a second weight positioned in the second pocket, wherein the second section is configured to be positioned over at least a portion of the lower leg of the body;

a second adhesive disposed on two internal opposing surfaces of the second pocket that is configured to hold the second weight in place; and a third section of the clothing material configured to be positioned over a knee of the body.

15. The leg sleeve of claim 14, wherein the first pocket and the second pocket are stitched shut.

16. The leg sleeve of claim 14, wherein the first pocket comprises a flap of clothing material configured to conceal an opening in the first pocket, and wherein the flap is movable to access the opening.

17. The leg sleeve of claim 14, wherein the first and second weights comprise a flexible thermoplastic polymer with embedded metal inserts.

18. The leg sleeve of claim 14, wherein the first weight comprises a magnetic material and further comprising at least one magnetic weight configured to couple with the first weight from an exterior surface of the leg sleeve.

* * * * *